US008727660B2

(12) United States Patent
Anderegg et al.

(10) Patent No.: US 8,727,660 B2
(45) Date of Patent: May 20, 2014

(54) ARRANGEMENT FOR PROVIDING A PULSING COMPRESSIVE FORCE

(75) Inventors: Roland Anderegg, Olten (CH); Martin Gerhard, Niederrohrdorf (CH); Kuno Kaufmann, Subingen (CH); Dominik Anton Von Felten, Aarau (CH)

(73) Assignee: Ammann Schweiz AG, Langenthal (CH)

( * ) Notice: Subject to any disclaimer, the term of this patent is extended or adjusted under 35 U.S.C. 154(b) by 0 days.

(21) Appl. No.: 13/641,621

(22) PCT Filed: Apr. 16, 2010

(86) PCT No.: PCT/CH2010/000104
§ 371 (c)(1),
(2), (4) Date: Nov. 12, 2012

(87) PCT Pub. No.: WO2011/127611
PCT Pub. Date: Oct. 20, 2011

(65) Prior Publication Data
US 2013/0058717 A1 Mar. 7, 2013

(51) Int. Cl.
*E01C 19/22* (2006.01)
*E01C 19/26* (2006.01)

(52) U.S. Cl.
USPC ..... 404/130; 404/117; 404/133.1

(58) Field of Classification Search
USPC ..... 404/117, 121–133.2
See application file for complete search history.

(56) References Cited

U.S. PATENT DOCUMENTS

| | | | | |
|---|---|---|---|---|
| 3,656,419 | A * | 4/1972 | Boone | 404/117 |
| 4,861,187 | A * | 8/1989 | Sinkkonen | 404/72 |
| 5,104,257 | A | 4/1992 | Lebrero Martinez et al. | |
| 5,906,254 | A | 5/1999 | Schmidt et al. | |
| 5,979,126 | A | 11/1999 | Kurino et al. | |
| 5,979,885 | A | 11/1999 | Katsuda | |
| 6,193,206 | B1 | 2/2001 | Yasuda et al. | |

(Continued)

FOREIGN PATENT DOCUMENTS

| | | | |
|---|---|---|---|
| CH | 248730 | A | 5/1947 |
| DE | 2217539 | A1 | 10/1973 |

(Continued)

OTHER PUBLICATIONS

International search report for PCT/CH2010/000104 dated Dec. 14, 2012.

*Primary Examiner* — Raymond W Addie
(74) *Attorney, Agent, or Firm* — McCormick, Paulding & Huber LLP

(57) ABSTRACT

The invention relates to a soil compacting device having an exciter part (1), which has an unbalance exciter (2) for producing an intermittent exciter force and a contact surface (3) for transmitting a force component of the exciter force directed perpendicularly to the contact surface (3) to the soil surface (4) to be compacted as a pulsing compressive force. The device also has a vibration damper part (5), which is connected to the exciter part (1) by means of a spring-damper unit (15). The spring stiffness of the spring-damper unit (15), the damping of the spring damper unit (15), the spring preload of the spring-damper unit (15), the mass of the vibration damper part (5), the mass moment of inertia of the vibration damper part (5), the mass of the exciter part (1), and/or the mass moment of inertia of the exciter part (1) can be varied during operation.

14 Claims, 8 Drawing Sheets

(56) References Cited

U.S. PATENT DOCUMENTS

| | | | | |
|---|---|---|---|---|
| 6,290,037 | B1 | 9/2001 | Williams et al. | |
| 7,017,679 | B2 * | 3/2006 | Sollinger et al. | 173/49 |
| 7,497,641 | B1 * | 3/2009 | Frelich | 404/130 |
| 7,775,742 | B2 * | 8/2010 | Buijsman | 404/122 |
| 8,206,061 | B1 * | 6/2012 | Hansen et al. | 404/128 |
| 2002/0170793 | A1 | 11/2002 | Kemeny | |
| 2004/0060792 | A1 | 4/2004 | Warmerdam | |
| 2004/0128040 | A1 | 7/2004 | Stiller et al. | |
| 2004/0222755 | A1 | 11/2004 | Fariborzi et al. | |
| 2006/0119026 | A1 | 6/2006 | Kasturi et al. | |
| 2006/0169557 | A1 | 8/2006 | Goetchius | |
| 2006/0225980 | A1 | 10/2006 | Simonian et al. | |
| 2006/0272910 | A1 | 12/2006 | Kraner | |
| 2007/0170680 | A1 | 7/2007 | Knaap | |

FOREIGN PATENT DOCUMENTS

| | | | |
|---|---|---|---|
| DE | 2905973 | A | 8/1980 |
| DE | 4135525 | A | 4/1992 |
| DE | 4241249 | A1 | 6/1993 |
| DE | 4314516 | C1 | 5/1994 |
| DE | 4405814 | A1 | 8/1994 |
| DE | 19621700 | A1 | 12/1997 |
| DE | 19812053 | A1 | 9/1999 |
| DE | 19943112 | A1 | 5/2000 |
| DE | 19958178 | C1 | 11/2000 |
| DE | 19930725 | C1 | 1/2001 |
| DE | 10315287 | A1 | 11/2004 |
| DE | 10326625 | A1 | 1/2005 |
| DE | 102005005770 | A1 | 8/2005 |
| DE | 102005059117 | A1 | 6/2007 |
| DE | 102006020785 | A1 | 11/2007 |
| DE | 102006022430 | A1 | 11/2007 |
| DE | 102007020050 | A1 | 10/2008 |
| DE | 102007039548 | A1 | 1/2009 |
| DE | 102008011208 | B3 | 9/2009 |
| EP | 0397488 | A | 11/1990 |
| EP | 0676559 | A1 | 10/1995 |
| EP | 0741051 | A2 | 11/1996 |
| EP | 0886079 | A2 | 12/1998 |
| EP | 1233204 | A1 | 8/2002 |
| EP | 1270151 | A1 | 1/2003 |
| EP | 1445131 | A2 | 8/2004 |
| EP | 1477870 | A2 | 11/2004 |
| EP | 1491791 | A2 | 12/2004 |
| EP | 1528281 | A1 | 5/2005 |
| EP | 1705293 | A1 | 9/2006 |
| EP | 1887125 | A1 | 2/2008 |
| FR | 2792554 | A1 | 10/2000 |
| FR | 2792696 | A1 | 10/2000 |
| FR | 2856126 | A1 | 12/2004 |
| GB | 2288577 | A | 10/1995 |
| GB | 2432403 | A | 5/2007 |
| GB | 2432404 | A | 5/2007 |
| GB | 2447231 | A | 9/2008 |
| JP | 57129943 | A | 8/1982 |
| JP | 4224334 | A | 8/1992 |
| JP | 10184099 | A | 7/1998 |
| JP | 2000065128 | A | 3/2000 |
| JP | 2000291725 | A | 10/2000 |
| JP | 2001153178 | A | 6/2001 |
| JP | 2001271870 | A | 10/2001 |
| JP | 2003227540 | A | 8/2003 |
| JP | 2004324871 | A | 11/2004 |
| JP | 2007078122 | A | 3/2007 |
| KR | 20020012787 | A | 2/2002 |
| SU | 905537 | B | 2/1982 |
| WO | 9116213 | A | 10/1991 |
| WO | 9202382 | A | 2/1992 |
| WO | 9844275 | A1 | 10/1998 |
| WO | 03000004 | A2 | 1/2003 |
| WO | 2006110274 | A1 | 10/2006 |
| WO | 2007003345 | A1 | 1/2007 |

* cited by examiner

ARRANGEMENT FOR PROVIDING A PULSING COMPRESSIVE FORCE

CROSS REFERENCE TO RELATED APPLICATIONS

This application claims the priority of PCT Application No. PCT/CH2010/000104, filed on Apr. 16, 2010, the disclosures of which are incorporated herein by reference in their entirety.

TECHNICAL FIELD

The invention relates to an arrangement for providing a pulsing compressive force, a soil compacting device comprising such an arrangement, a method for operating such an arrangement or such a soil compacting device as well as the use of such an arrangement for compacting soil.

BACKGROUND OF THE INVENTION

Compacting devices which operate according to the so-called damper principle are used particularly in the field of compacting soil. An even plate or a roller body (drum), which forms the soil contact surface, is excited to oscillations by means of an unbalance exciter. The plate or the roller body is connected via a spring damper system to a damper mass arranged above it, which is also excited to oscillations via the spring damper system. If the damper mass oscillates with the same phase with the same frequency (1:1 resonance) or with half of the frequency (2:1 resonance) of the plate or the roller body, a maximum soil compacting force is attained by this machine concept (damper principle), which corresponds to the power of substantially larger or heavier machines without damper mass.

Due to the system, the problem arises in case of such soil compacting devices that the oscillating behaviour of the plate or the roller body, which excites the damper mass to oscillations, is influenced by the stiffness of the soil to be compacted, which may be different in different locations and which additionally changes during the compacting of the soil. In practice this leads to the fact that simpler devices with fixed exciter frequencies can rarely be operated at their optimal operating point (1:1 resonance or 2:1 resonance) and therefore cannot exploit their entire potential. Furthermore it is possible to experience an earlier wear or even destruction when operating them in a suboptimal range.

In case of technically more complex systems with damper exciters which can be regulated the desired resonance state can be reached by varying the exciter frequency in large parts, such that at least the last mentioned problem can be avoided. However, in this case there is the disadvantage that the required exciter frequency for producing the resonance state is often energetically suboptimal, which again leads to the fact that these devices do not entirely exploit their power potential as well.

Therefore, the invention has the objective to provide technical means by means of which the disadvantages of the prior art mentioned above can be at least partially overcome.

This objective is solved by present invention.

Accordingly, a first aspect of the invention relates to an arrangement for providing a pulsing compressive force. The arrangement comprises an exciter part with an unbalance exciter for producing an intermittent exciter force and with a contact surface for transmitting a force component of the exciter force, directed perpendicularly to the contact surface, as a pulsing compressive force, to a tool or a work surface to be impinged with the compressive force. Furthermore, the arrangement comprises a vibration damper part which is connected to the exciter part by means of a spring-damper unit, for forming a system capable of oscillating and which is excited to resonant oscillations by the unbalance exciter.

SUMMARY OF THE INVENTION

According to the invention the arrangement is adapted to vary during operation the spring stiffness (also called spring constant) of the spring damper unit, the damping of the spring-damper unit, the spring pre-load of the spring damper unit, the mass of the vibration damper part, the mass moment of inertia of the vibration damper part acting on the spring damper unit, the mass of the exciter part, and/or the mass moment of inertia of the exciter part acting on the spring damper unit.

By this it is possible to keep in resonance, at a tool or a working surface, the system capable of oscillations formed by the exciter part, the spring damper unit and the vibration damper part, at a given exciter frequency for different coupling stiffnesses of the contact surface and thereby to enable an energetically optimal operation with a maximum pulsing compressive force provided at the contact surface in the presence of different or changing operation conditions. Accordingly, it is for the first time possible with the arrangement according to the invention, to provide soil compacting devices working according to the damper principle, which can always be operated in the optimal operation point for different soil types and for a gradual compacting, with corresponding advantages with respect to the compacting power and durability of the devices.

Preferably, the unbalance exciter of the arrangement according to the invention is formed as directed vibrator or as circular vibrator. Depending on the planned usage the one or the other alternative may be more advantageous. Accordingly, it is advantageous, e.g. for the case that a vibration plate for compacting the soil shall be formed by the arrangement, that the unbalance exciter is formed as directed vibrator because it is possible to implement in this way at the same time the actuation of the vibration plate by inclining the oscillating direction with respect to the vertical. If, contrary to this, a compactor with a separate actuation shall be formed by the arrangement, it is preferred to form the unbalance exciter as a simple circular vibrator, because such unbalance exciters are constructively simple to build and thus are robust and cost saving.

In a preferred embodiment the arrangement is formed in such a way that the vibration damper part of the arrangement is exclusively supported on the exciter part in the direction of gravity by means of the spring damper unit, when operated as intended. Preferably, the vibration damper part is arranged above the exciter part for this, such that a simple construction results. Such embodiments of the arrangement are preferably used for forming vibration plates for compacting the soil, in case of which the entire device unit is supported on the soil via the bottom plate.

In another preferred embodiment the arrangement is formed in such a way that the vibration damper part is partially supported on the exciter part via the spring damper unit and partly on supporting means which are formed separately from the exciter part, when operated as intended. In this way the vibration damper part carries out an intermittent inclined oscillation about an inclination axis in the area of the supporting means which are decoupled from the exciter part in terms of oscillations, when operated as intended. In case of such an embodiment it is possible in a simple way to vary the mass moment of inertia of the vibration damper part, which acts at the spring damper unit, as well as the spring pre-load of the spring damper unit and thereby to influence the oscillation behaviour of the arrangement by varying the weight distribution between the weight portion of the vibration damper part which has to be supported by the exciter part and the weight portion of the vibration damper part which has to be supported by the supporting means. This can e.g. be done by shifting a weight onto the vibration damper part, this being also possible during operation with simple means, like for example a motor spindle.

In yet another preferred embodiment of the invention the arrangement has an idle part which is connected to the exciter part or the vibration damper part in such a way that it forms contiguous unit with this part but is substantially decoupled from it in terms of oscillations. By this there is the advantage that the arrangement has a section which is subject to comparatively small accelerations in operation and which is therefore suitable for acting as mechanic interface for the operators and as installation location for controller components, as the case may be.

Thereby, in a first preferred variant of this embodiment it is provided that the idle part is exclusively supported by the exciter part or by the vibration damper part, if operated as intended. If the arrangement according to the invention is e.g. formed as manually guided vibration plate for compacting soil, the guide drawbar of the vibration plate, which also carries the operating elements, forms such an idle part in such a way that it is supported by means of an oscillation isolating bearing arrangement on the vibration damper part or the exciter part and is carried by it.

In a second preferred variant of this embodiment the idle part is supported entirely by supporting means which are substantially decoupled from the exciter part and the vibration damper part in terms of oscillations, when operated as intended. Consequently, it is e.g. preferred to form the arrangement according to the invention as a soil compacting device consisting of a soil compacting attachment and a wheel bearing or excavator attached to it, which takes over exclusively the guiding and the actuation of the arrangement in horizontal direction but does neither support the arrangement in vertical direction nor exerts a force on it, when operated as intended. The soil compacting attachment may also be formed as a vibration plate or as a vibration-excited roller body.

In a third preferred variant of this embodiment it is provided that the idle part is supported partially by the exciter part or by the vibration damper part and partially by supporting means which are substantially decoupled from the exciter part and the vibration damper part in terms of oscillations, when operated as intended. If e.g. the arrangement according to the invention is formed as a compactor for compacting the soil, the actuation unit forms with the cab such an idle part by being supported at one end by oscillation isolating bearings on the exciter part formed as a compacter or on the vibration damper part and at the other end on the soil via actuating wheels.

For this third variant it is advantageous that the arrangement is formed in such a way that in operation a variation of the weight distribution between the weight portion of the idle part, which is supported by the exciter part or the vibration damper part respectively, and the weight portion of the idle part which has to be supported by the supporting means is possible, preferably by shifting a weight on the idle part. By this it is possible to influence the oscillation behaviour of the arrangement.

Furthermore it is preferred for embodiments of the arrangement according to the invention, which have an idle part, that the arrangement is formed in such a way that a variation of the mass of the vibration damper part, the mass moment of inertia of the vibration damper part, the mass of the exciter part and/or the mass moment of inertia of the exciter part is possible by exchanging one or more liquid volumes between the idle part and the exciter part and/or the vibration damper part. In this way it is possible to influence the oscillation behaviour of the arrangement in large areas. Similarly, it is also conceivable to vary the mass moment of inertia of the exciter part and/or of the vibration damper part by shifting one or more liquid volumes inside the exciter part and/or inside the vibration damper part.

If the arrangement according to the invention is formed in such a way that a variation of the mass of the vibration damper part, the mass moment of inertia of the vibration damper part, the mass of the exciter part and/or the mass moment of inertia of the exciter part is possible by exchanging one or more liquid volumes between the vibration damper part and the exciter part, wherein this is preferred, it is possible to influence the oscillation behaviour of the arrangement in large areas even without the presence of an idle part.

In a further preferred embodiment the arrangement according to the invention is formed in such a way that the vibration damper part and/or the exciter part has at least two masses which are movable towards one another when accelerating the vibration damper part or the exciter part respectively, in a direction perpendicular to the contact surface, against a spring force, wherein the spring force is variable in operation. By this it is possible to vary in a simple way the mass moment of inertia of the vibration damper part or the exciter part respectively, acting on the spring damper unit, when the mass of the vibration damper part or the exciter part is constant.

In yet a further preferred embodiment the arrangement according to the invention is formed in such a way that a variation of the spring stiffness of the spring damper unit is possible by stiffening spring elements of the spring damper unit and/or by varying the force introduction in spring elements of the spring damper unit. In the first mentioned case it is e.g. provided that hollow elastomer springs are used, the spring stiffness of which can be varied by impinging its interior with a fluid under pressure, by variating the fluid pressure. In the last mentioned case the variation of the force introduction is done preferably by varying a transmission of the introduced forces, e.g. by means of length variable knee levers.

If the arrangement according to the invention is formed in such a way that the frequency of the exciter force, the quantity of the exciter force and/or the direction of action of the exciter force of the unbalance exciter are variable during operation, which is also preferred, the advantage results that the arrangement has a maximal flexibility for adjusting to different or changing operation conditions.

Furthermore it is preferred that the arrangement comprises a, particularly electronic, controlling unit or regulating unit respectively, by means of which the spring stiffness of the spring damper unit, the damping of the spring-damper unit, the spring pre-load of the spring damper unit, the mass of the vibration damper part, the mass moment of inertia of the vibration damper part, the mass of the exciter part, and/or the mass moment of inertia of the exciter part is or are automatically adjustable in operation depending on measured system variables, particularly in such a way that the vibration damper part oscillates in resonance with the exciter part, particularly with the same frequency or with half of the frequency of the exciter part.

If the arrangement according to the invention is formed in such a way that the frequency of the exciter force, the quantity of the exciter force and/or the direction of action of the exciter force of the unbalance exciter is or are adjustable in operation, which is preferred, it is advantageous that additionally the frequency of the exciter force, the quantity of the exciter force and/or the direction of action of the exciter force of the unbalance exciter is or are adjustable automatically during operation depending on measured system variables by means of the controlling unit or regulating unit respectively, preferably in such a way that the vibration damper part oscillates in resonance with the exciter part with the same frequency or with half of the frequency of the exciter part.

By such arrangements according to the invention it is possible to provide soil compacting devices which automatically work always in the optimal working point.

A second aspect of the invention relates to a soil compacting device with an arrangement according to the first aspect of the invention, in case of which, according to the claims, the contact surface of the arrangement serves as tool for compacting the soil. The advantages of the invention are particularly given in case of such devices.

In a preferred embodiment the soil compacting device is a vibration plate or roller, particularly a roller with one or two vibration-excited roller bodies (drums) arranged one after the other in rolling direction.

A third aspect relates to a method for operating the arrangement according to the first aspect of the invention or to the soil compacting device according to the second aspect of the invention. According to the method the arrangement is operated as intended with the contact surface in contact with a tool performing an action or a work surface to be processed, particularly to be compacted, like for example a soil surface to be compacted.

Thereby, the spring stiffness (also called spring constant) of the spring-damper unit, the damping of the spring-damper unit, the spring pre-load of the spring damper unit, the mass of the vibration damper part, the mass moment of inertia of the vibration damper part, the mass of the exciter part and/or the mass moment of inertia of the exciter part is varied such that the oscillating behaviour of the system capable of oscillations, formed by the exciter part, the spring damper unit and the vibration damper part, changes. In this way it is possible to optimize the arrangement or the soil compacting device for different applications or operation situations respectively.

In a preferred embodiment of the method the frequency of the exciter force, the quantity of the exciter force and/or the direction of action of the exciter force of the unbalance exciter is or are adjustable in operation of the arrangement as intended, with the result that an even better adjustment of the arrangement or the soil compacting device to different operation conditions is possible.

Preferably, the spring stiffness of the spring damper unit, the damping of the spring-damper unit, the spring pre-load of the spring damper unit, the mass of the vibration damper part, the mass moment of inertia of the vibration damper part, the mass of the exciter part, and/or the mass moment of inertia of the exciter part and/or, where applicable, the frequency of the exciter force, the quantity of the exciter force and/or the direction of action of the exciter force of the unbalance exciter is or are adjustable in such a way that the vibration damper part oscillates in resonance with the exciter part, particularly with the same frequency or with half of the frequency of the exciter part. By this it is possible to provide at the contact surface of the arrangement according to the invention a pulsing compressive force of maximal amount.

In a further preferred embodiment of the method system parameters of the system excited to oscillations by the unbalance exciter, formed by the exciter part, the spring damper unit and the vibration damper part are determined during the operation as intended of the arrangement, particularly the accelerations of the exciter part and/or of the vibration damper part in a direction perpendicular to the contact surface as well as the rotation frequency of the unbalance exciter. The variation of the spring stiffness of the spring damper unit, the damping of the spring-damper unit, the spring pre-load of the spring damper unit, the mass of the vibration damper part, the mass moment of inertia of the vibration damper part, the mass of the exciter part, and/or, where applicable, the frequency of the exciter force, the quantity of the exciter force and/or the direction of action of the exciter force of the unbalance exciter is carried out depending on one or more of the determined system parameters. In this way it is possible to set a certain oscillation behaviour of the system capable of oscillations, formed by the exciter part, spring damper unit and vibration damper part.

Preferably, for the method according to the invention the variation of the spring stiffness of the spring damper unit, the damping of the spring damper unit, the spring pre-load of the spring damper unit, the mass of the vibration damper part, the mass moment of inertia of the vibration damper part, the mass of the exciter part and/or the mass moment inertia of the exciter part, and/or, where applicable, the frequency of the exciter force, the quantity of the exciter force and/or the direction of action of the exciter force of the unbalance exciter as well as, where applicable, the determination of the system parameters, is carried out automatically by means of a, particularly electronic, controlling unit or regulating unit respectively. By this it is possible to form the arrangement or the soil compacting device respectively, in such a way that it adjusts automatically to the encountered operation conditions if operated as intended, e.g. that it adjust itself in such a way that the vibration damper part oscillates in resonance with the exciter part, in the presence of an exciter frequency which is as high as possible.

A fourth aspect of the invention relates to the use of the arrangement according to the first aspect of the invention for compacting soil. In such a use the advantages of the invention are particularly obvious.

BRIEF DESCRIPTION OF THE DRAWINGS

Further embodiments, advantages and applications of the invention are described in the following description with the aid of the figures.

DESCRIPTION OF THE PREFERRED EMBODIMENTS

Figure 2:
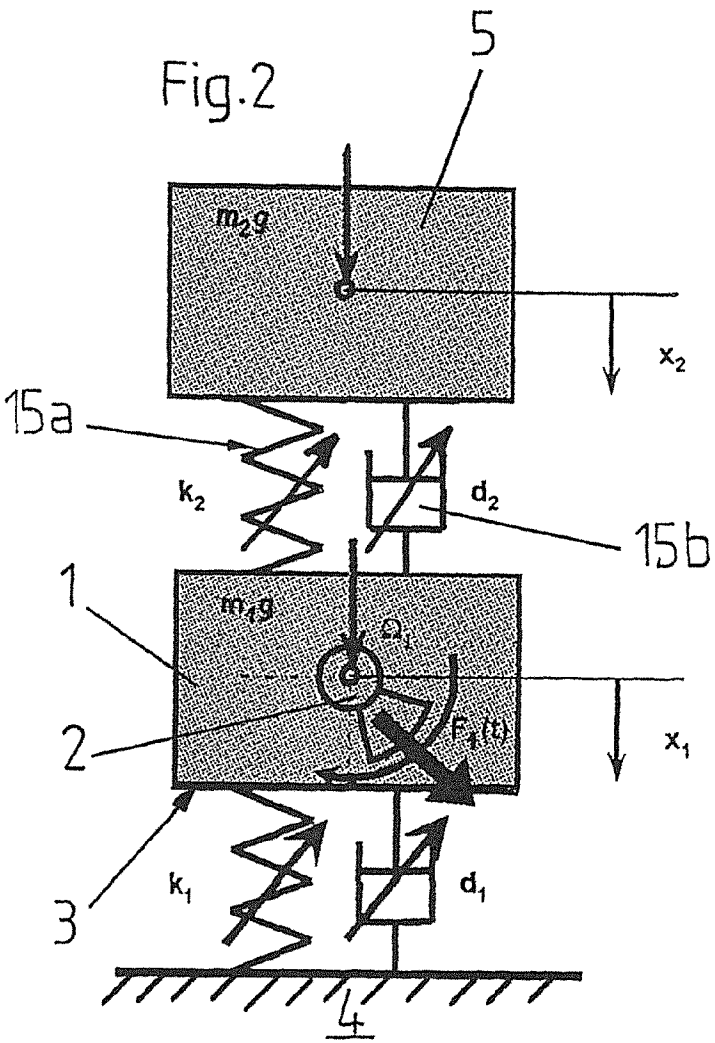
FIG. 2 the oscillation model of the system capable of oscillations of the vibration plate of FIG. 1.
Figure 1:
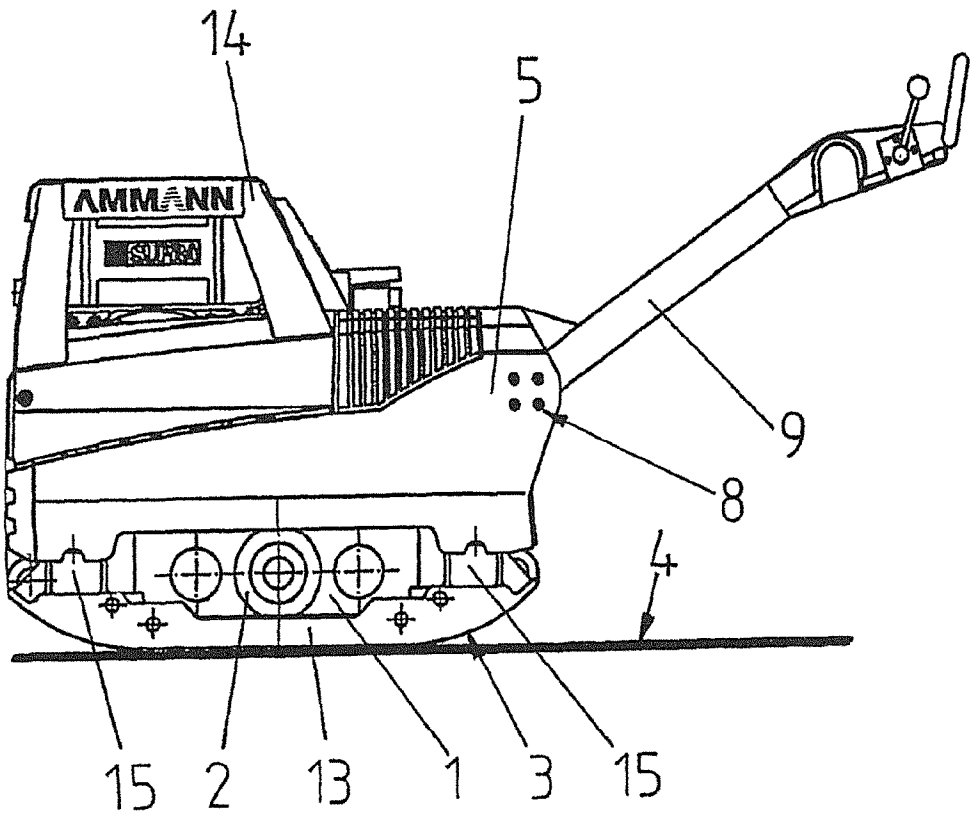
FIG. 1 a side view of a first vibration plate for compacting soil according to the invention.

FIG. 1 shows a first soil compacting device according to the invention, formed as a vibration plate, in a side view. FIG. 2 shows schematically the oscillation model of the system capable of oscillations of this vibration plate.

As can be seen, the vibration plate has a lower carriage 1 (exciter part according to the claims) and an upper carriage 5 (vibration damper part according to the claims).

The lower carriage 1 comprises a soil contact plate 13 which has on its underside a contact surface 3 for introducing the pulsing compressive force generated by the vibration plate into the soil 4 to be compacted, and an unbalance exciter 2 with a hydraulic motor, formed as directed vibrator, which generates an intermittent exciter force which is substantially oriented vertically, which is introduced into the soil contact plate 13.

The upper carriage 5 comprises an actuation engine 14 with a diesel motor, which actuates a hydraulic pump and an air compressor. The hydraulic pump supplies the hydraulic motor of the unbalance exciter 2 via hydraulic conduits with a stream of hydraulic liquid which is under pressure, for actuating the unbalance exciter 2. The chassis of the upper carriage 5 is dimensioned with respect to weight in such a way that, together with the actuation unit 14, a certain overall mass of the upper carriage results as damper mass.

The upper carriage 5 is supported on the lower carriage 1 in the direction of gravity via four hollow elastomer springs 15 (spring damper unit according to the claims) which are variable with respect to their spring stiffness and their damping behaviour. No further supporting of the upper carriage 5 in the gravity direction is present.

In the oscillation model according to FIG. 2 the hollow elastomer springs 15 are represented by the spring 15*a* with the spring stiffness k2 and the damper 15*b* with the damping d2. The mass of the upper carriage 5 is denoted by m2*g* and the one of the lower carriage 1 by m1*g* and the movements of the upper and lower carriage in vertical direction by x2 and x1. The spring stiffness of the soil 4 is denoted by k1 and its damping by d1. Furthermore, in FIG. 2 the rotation frequency of the unbalance exciter 2 is denoted by Ω1 and its exciter force by F1.

Figure 3C:
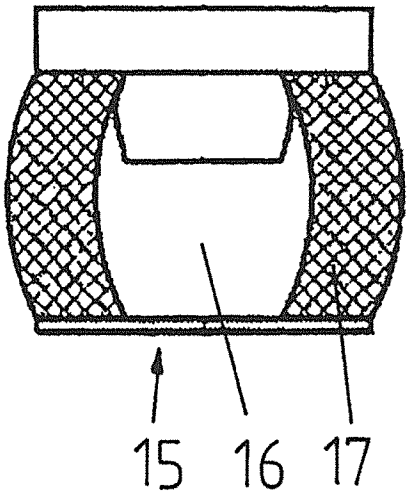
FIGS. 3*a* to 3*c* sections through a hollow elastomer spring of the system capable of oscillations of the vibration plate of FIG. 1 in the presence of different hollow space interior pressures.
Figure 3B:
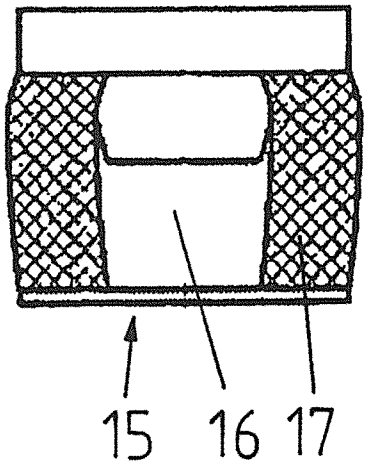
Figure 3A:
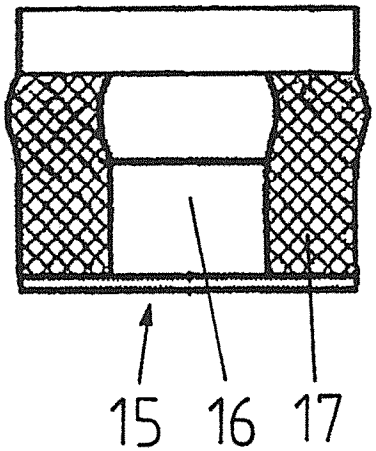

The construction of the hollow elastomer springs 15 can be seen in FIG. 3*a* to 3*c*, which shows sections through one of the hollow elastomer springs 15 in the presence of an overpressure in its interior 16 of 0 bar (FIG. 3*a*), of 2 bar (FIG. 3*b*) and of 4 bar (FIG. 3*c*). As can be seen, the elastomer body 17 of the hollow elastomer spring 15 extends with increasing pressure in the interior 16 increasingly in axial direction (load direction) and bulges increasingly in radial direction. The stiffness of the hollow elastomer spring 15 increases with an increasing pressure in the interior 16.

In case of the vibration plate shown in FIG. 1 the interior spaces 16 of the elastomer spring elements 15 are connected with the air compressor of the actuating unit 14 via conduits and control valves and may be acted upon in a targeted way with an overpressure between 0 bar and 6 bar in order to vary the spring stiffness of the elastomer spring elements 15.

A guide drawbar 9 (idle part according to the claims) is attached to the upper carriage 5 by means of oscillation isolating attachment elements 8, which carries the operating elements and serves for the guide of the vibration plate by an operator. The oscillation isolating attachment elements 8 are dimensioned in such a way that the guide drawbar 9 forms a contiguous unit with the upper carriage 5, it is however decoupled from the latter.

Furthermore, the vibration plate comprises an electronic controlling unit or regulating unit respectively, by means of which in operation the accelerations of the upper carriage 5 and the lower carriage 1 in vertical direction, i.e. perpendicular to the contact surface 3, as well as the rotation frequency Ω1 of the unbalance exciter 2 can be determined and, depending on these determined system parameters, the stiffness and damping of the elastomer spring elements 15 can be automatically varied by varying the overpressure in its interior 16 in such a way that the upper carriage 5 always oscillates in resonance with the lower carriage 1. Additionally, the controlling unit or regulating unit respectively, can automatically regulate the rotation frequency of the unbalance exciter 2 during the operation in such a way that a maximal compacting power is reached.

Figure 5:
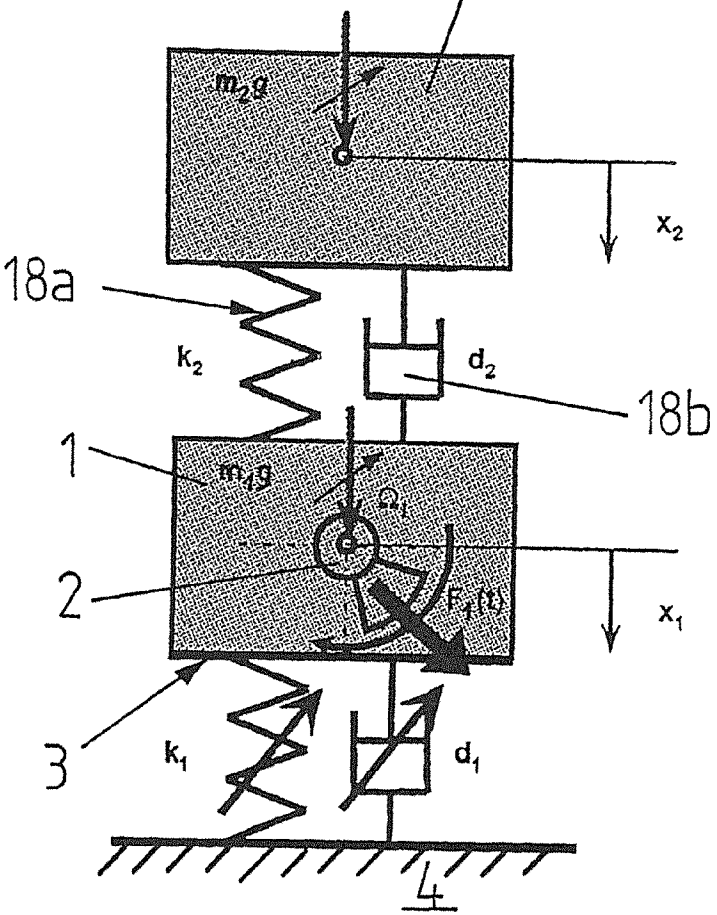
FIG. 5 the oscillation model of the system capable of oscillations of the vibration plate of FIG. 4.
Figure 4:
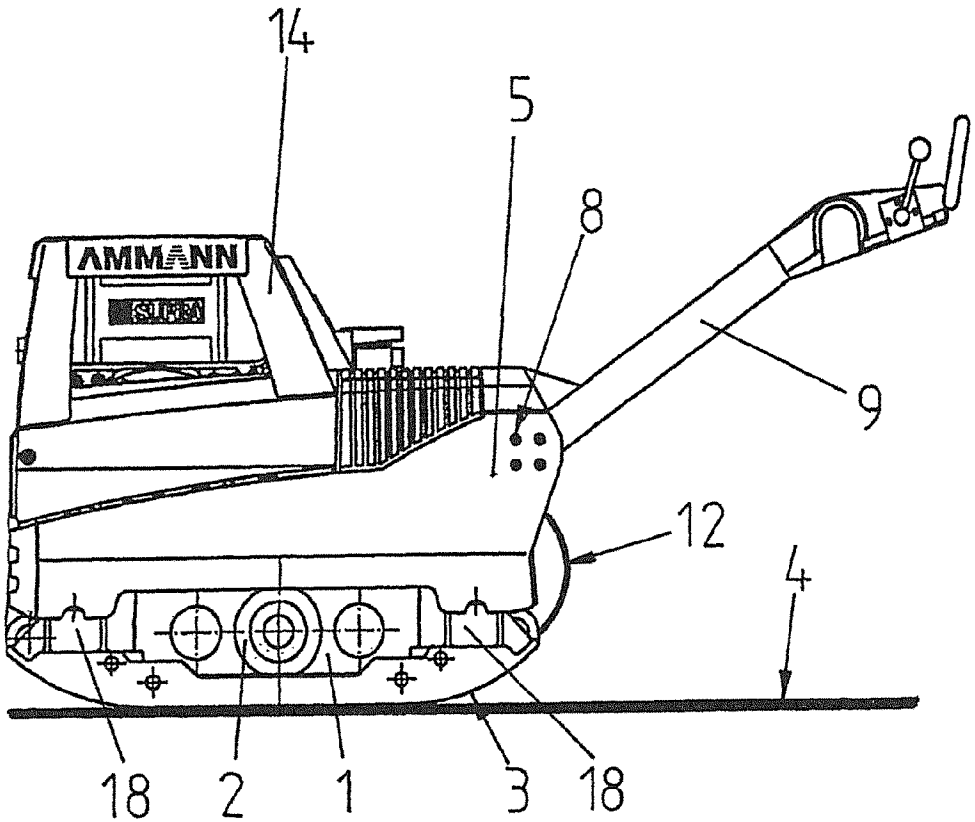
FIG. 4 a side view of a second vibration plate for soil compacting according to the invention.

FIG. 4 shows a second soil compacting device according to the invention formed as vibration plate in a side view and FIG. 5 shows schematically the oscillation model of the system capable of oscillations of this second vibration plate.

As can be seen, this vibration plate is constructed in the same way, except for few details, like the first vibration plate according to FIGS. 1 and 2. A central difference is however that, in case of the vibration plate shown here, the upper carriage 5 is supported on the lower carriage 1 via the elastomer springs 18, the stiffness of which is not changeable. In the oscillation model according to FIG. 5 the elastomer springs 18 are represented by the spring 18*a* with the spring stiffness k2 and the damper 18*b* with the damping d2.

A further central difference is that here the masses m1*g*, m2*g* of the lower carriage 1 and the upper carriage 5 can be varied in operation in a targeted way by exchanging liquid between the upper carriage 5 and the lower carriage 1 via a connecting conduit 12. For this, ballast tanks formed as piston accumulators are present in the lower carriage 1 as well as in the upper carriage 5, the volume of which can be varied in a targeted way and contrary directed by means of hydraulic actuators and a corresponding controlling unit or regulating unit.

In the present case, the electronic controlling unit or regulating unit is also formed in such a way that it can determine in operation the accelerations of the upper carriage 5 and the lower carriage 1 in vertical direction, i.e. perpendicular to the contact surface 3, as well as the rotation frequency Ω1 of the unbalance exciter. Contrary to the controlling unit or regulating unit of the vibration plate according to FIGS. 1 and 2, the controlling unit or regulating unit changes here in operation the masses m1*g*, m2*g* of the lower carriage 1 and the upper carriage 5 automatically depending on these determined system parameters in such a way that the upper carriage 5 oscillates in resonance with the lower carriage 1.

Figure 7:
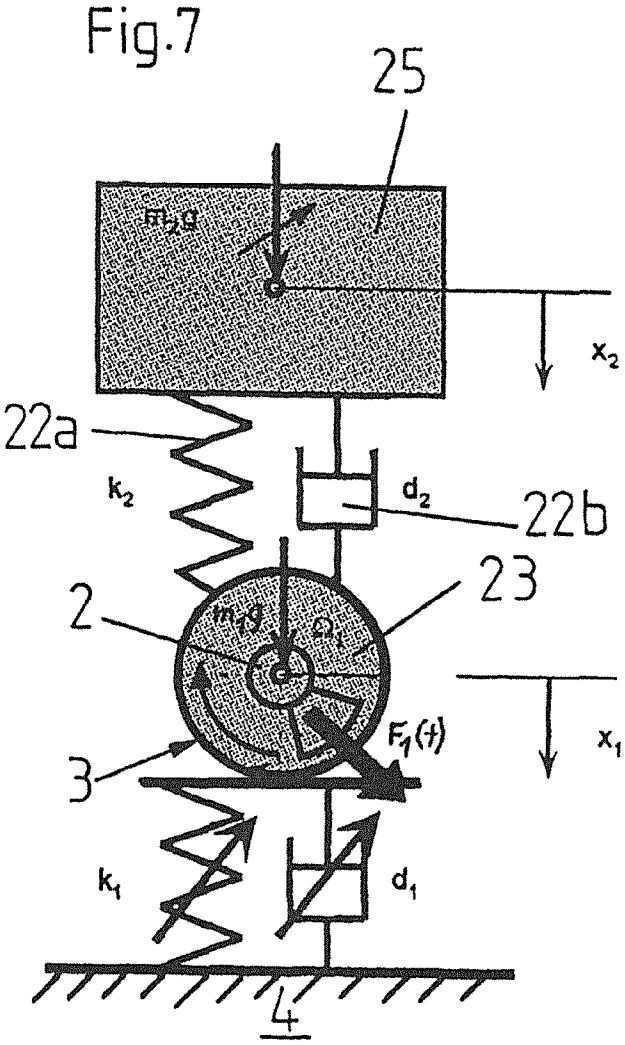
FIG. 7 the oscillation model of the system capable of oscillations of the compactor of FIG. 6.
Figure 6:
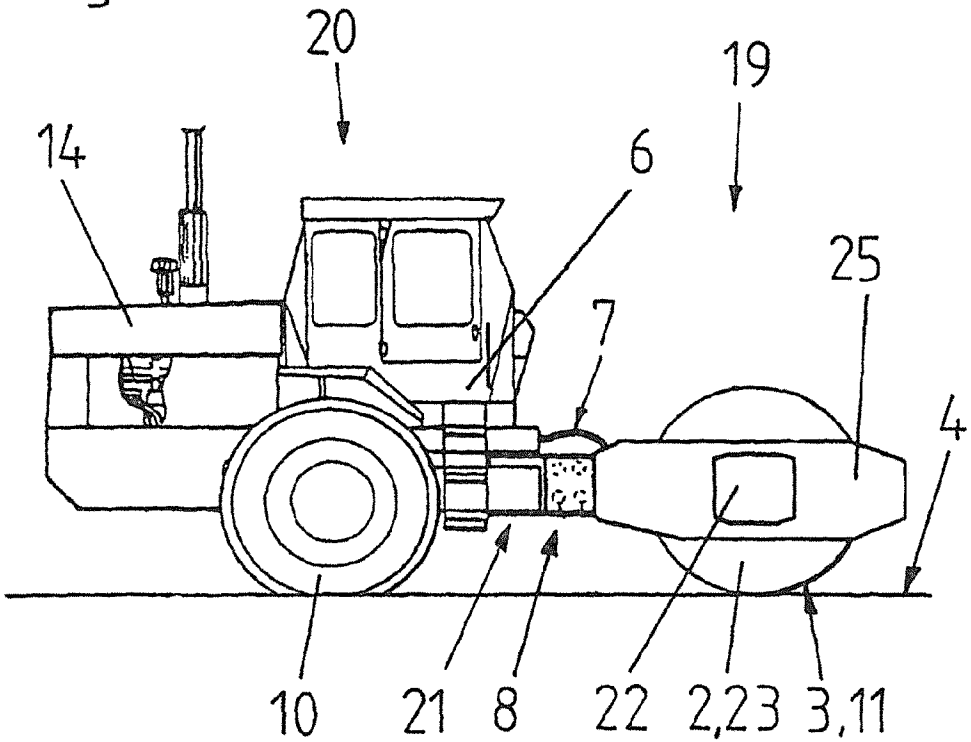
FIG. 6 a side view of a first compactor for soil compacting according to the invention.

FIG. 6 shows a first embodiment of a soil compacting device formed as a compacter in side view and FIG. 7 schematically the oscillation model of the system capable of oscillations of this compacter.

As can be seen, the compacter has a front part 19 and a rear part 20, which are connected to one another by a knee joint 21.

The front part 19 of the compacter consists substantially of a roller body 23 and a chassis frame 25.

The roller body 23 comprises a drum 11 which has the contact surface 3 for the introduction of the generated pulsing compressive force into the soil 4 to be compacted, and an unbalance exciter 2 with a hydraulic motor formed as circular vibrator, which generates an exciter force which is intermittent with respect to its direction of action and which is introduced into the drum 11.

The chassis frame 25 is supported in gravity direction via two spring damper arrangements 22 (spring damper units according to the claims) with unchanged stiffness and damping on the two end-side bearings of the roller body 23 and is connected to the knee joint 21, which is supported by the rear part 20 of the compacter, by oscillation isolating attachment elements 8. The oscillation isolating attachment elements 8 are dimensioned in such a way that the rear part 20 of the compacter forms a contiguous unit with the chassis frame 25, but it is decoupled from the latter in terms of oscillations and therefore is an idle part as according to the claims.

The rear part 20 of the compacter consists substantially of an actuating unit 14 with a diesel motor, which actuates a hydraulic pump, and a cab 6. It is supported on the soil 4 by two actuating wheels 10 which are actuated by hydraulic motors. The hydraulic pump supplies in operation each of the hydraulic motor of the unbalance exciter 2 of the compacter 23 and the hydraulic motors of the actuating wheels 10, via hydraulic conduits, with a stream of hydraulic liquid being under pressure, for actuating the actuating wheels 10 and the unbalance exciter 2 of the roller body 23.

Liquid tanks are arranged in the rear part 20 and in the chassis frame 25 of the front part 19 of the compacter, between which liquid can be exchanged via a conduit pipe 7. By this it is possible to vary in operation the mass m2*g* of the chassis frame 25.

Depending on weight distribution the chassis frame 25 is additionally supported on the rear part 20 of the compacter by the knee joint 21 or the rear part 20 is additionally supported on the chassis frame 25 via the knee joint 21.

The spring damper arrangements 22 are represented in the oscillation model according to FIG. 7 by the spring 22*a* with the spring stiffness k2 and the damper 22*b* with the damping d2. The mass of the chassis frame 25 is denoted by m2*g* and the one of the roller body 23 by m1*g*. The movement of the chassis frame 25 is denoted by x2 and the one of the roller body 23 by x1. The stiffness of the soil 4 is denoted by k1 and its damping by d1. Additionally, in FIG. 7 the rotation frequency of the unbalance exciter 2 is denoted by Ω1 and its exciter force by F1.

Furthermore, the compacter is equipped with an electronic controlling unit or regulating unit respectively, which makes it possible to determine in operation the accelerations of the chassis frame 25 and of the roller body 23 in vertical direction as well as the rotation frequency Ω1 of the unbalance exciter and to adjust the mass m2*g* of the chassis frame 25 automatically depending on these determined parameters in such a way that the chassis frame 25 always oscillates in resonance with the roller body 23.

Figure 8:
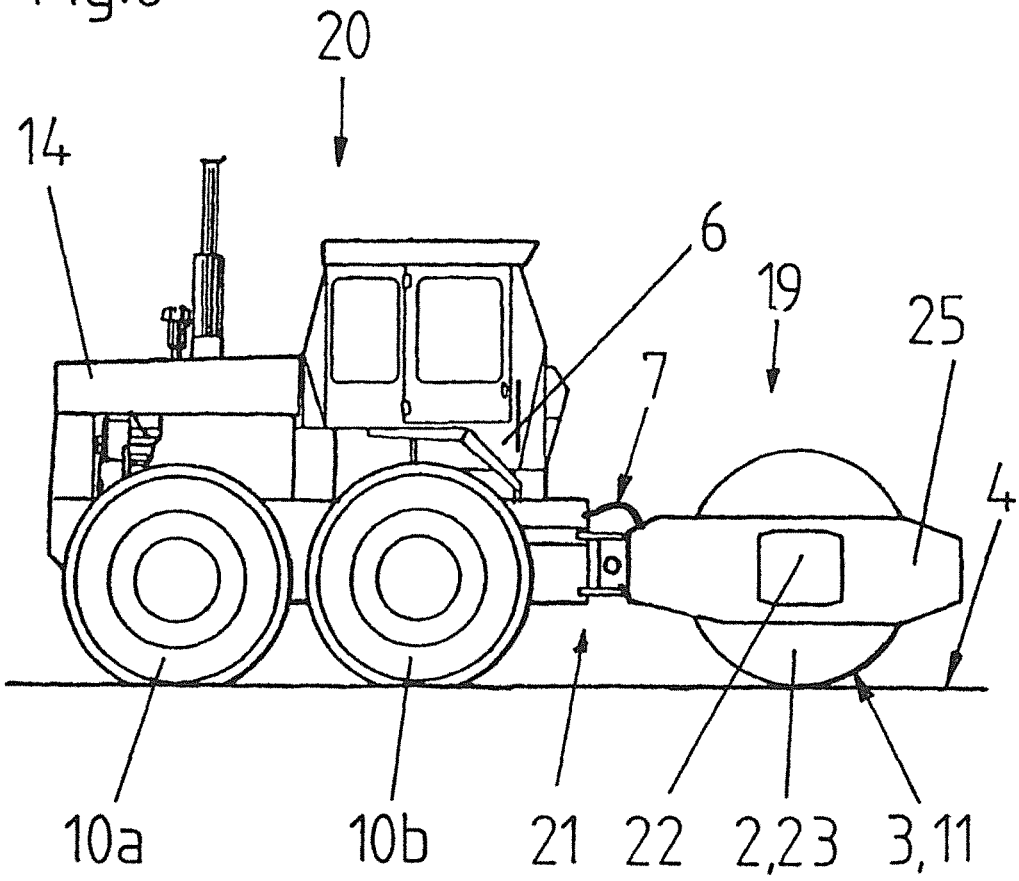
FIG. 8 a side view of a second compactor for soil compacting according to the invention.

FIG. 8 shows a second embodiment of a soil compacting device according to the invention, formed as a compacter, in side view.

This second compacter differs from the first compacter shown in FIG. 6 only by the fact that the rear part 20 of the compacter is formed by a wheel bearing which is supported entirely on four actuating wheels 10*a*, 10*b* of two axes arranged one after the other and is connected to the chassis frame 25 in such a way that it only guides and actuates the latter in horizontal direction, when operated as intended, but does not receive from it or transmit to it any forces acting in vertical direction. Here, the rear part 20 is also decoupled in terms of oscillations from the chassis frame 25 and the roller body 23 of the front part 19 of the compacter and therefore forms an idle part, as according to the claims.

Figure 9:
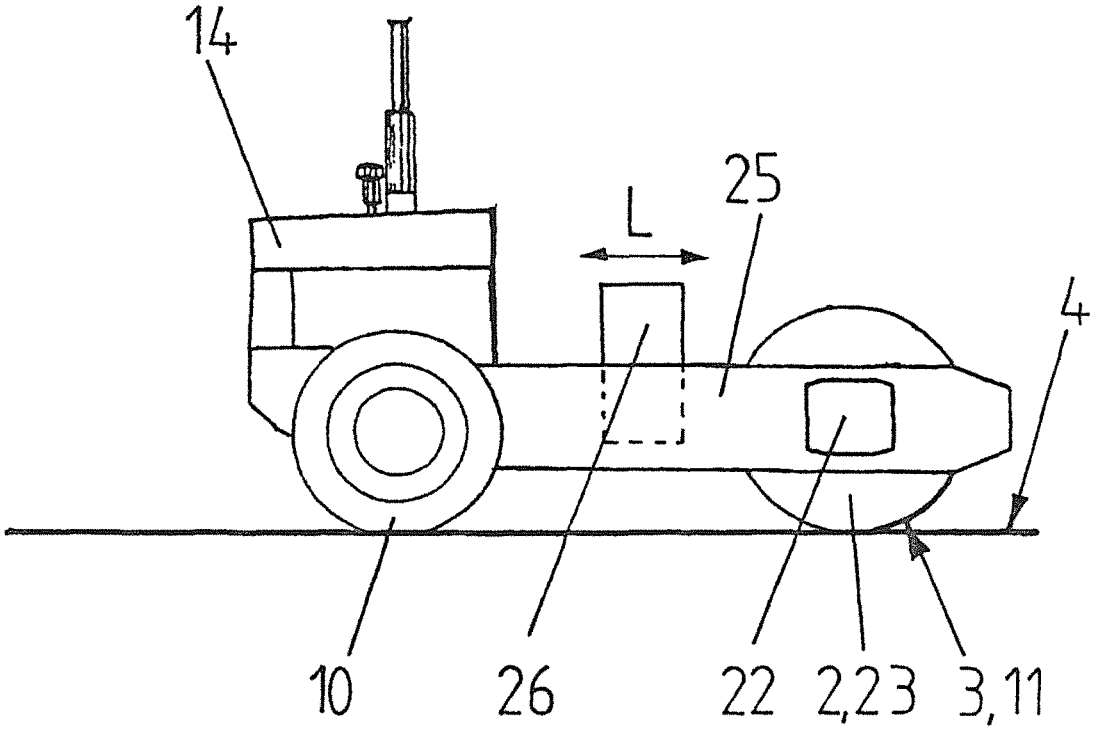
FIG. 9 a side view of a third compactor for soil compacting according to the invention.

FIG. 9 shows a third embodiment of a soil compacting device according to the invention, formed as a compacter, in side view. This is an unmanned compacter which is operated by a radio remote control.

As can be seen, this third compacter comprises a roller body 23 (exciter part according to the claims) and a chassis frame 25 (vibration damper part according to the claims), which is supported in gravity direction at one end via two spring damper arrangements 22 (spring damper unit according to the claims) with unchanged stiffness and damping on the two end-side bearings of the roller body 23 and at the other end on two actuating wheels 10 actuated by hydraulic motors.

The roller body 23 comprises a drum 11 which has the contact surface 3 for the introduction of the generated pulsing compressive force into the soil 4 to be compacted, and an unbalance exciter 2 formed as a circular vibrator with a hydraulic motor, which generates a force which is intermittent with respect to its direction of action, which is introduced into the drum 11.

The chassis frame 25 carries in the area where it is supported by the actuating wheels 10 an actuating unit 14 with a diesel motor, which actuates a hydraulic pump. The hydraulic pump supplies in operation each of the hydraulic motor of the unbalance exciter 2 of the compacter 23 and the hydraulic motors of the actuating wheels 10, via hydraulic conduits, with a stream of hydraulic liquid being under pressure, for actuating the actuating wheels 10 and the unbalance exciter 2 of the compacter 23.

The chassis frame 25 carries a trim weight 26 in the area between the actuating unit 14 and the roller body 23, which can be shifted in longitudinal direction L in operation by means of a hydraulic motor and a threaded spindle. By this, the mass moment of inertia of the chassis frame 25, which in operation executes an inclined oscillation about a rotation axis in the area of the foot prints of the actuating wheels 10 and which acts on the spring damper arrangements 22, can be varied, as well as the supporting pressure of the spring damper arrangements 22, such that their spring pre-load changes.

This third compacter is also equipped with an electronic controlling unit or regulating unit respectively, which makes it possible to determine in operation the accelerations of the chassis frame 25 and of the roller body 23 in vertical direction as well as the rotation frequency Ω1 of the unbalance exciter and to adjust the mass m2*g* of the chassis frame 25 automatically depending on these determined parameters in such a way that the chassis frame 25 always oscillates in resonance with the roller body 23.

Figure 10:
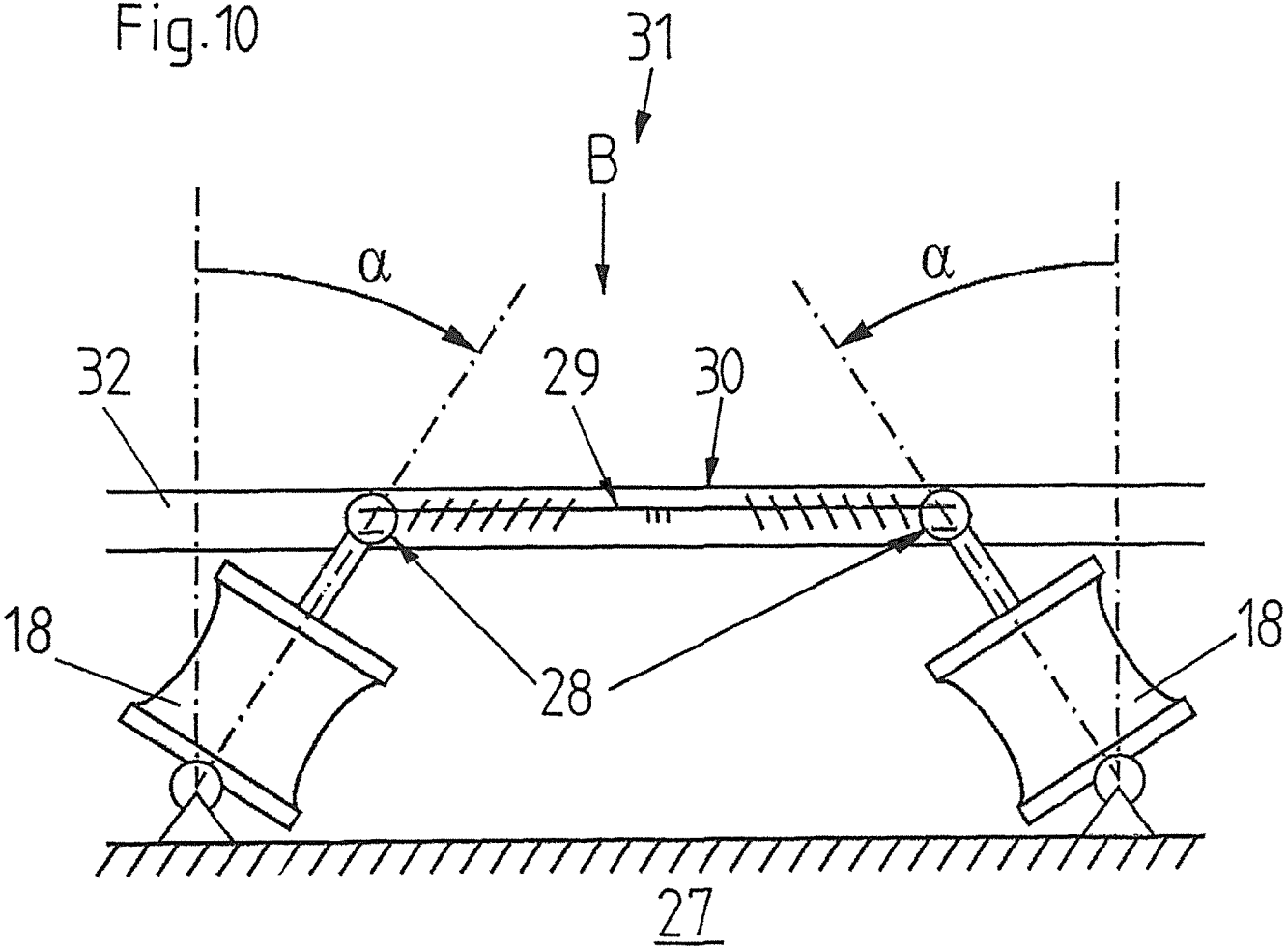
FIG. 10 a schematic illustration of a spring damper system with adjustable spring stiffness.

FIG. 10 shows in a conception view a spring damper arrangement 31, the spring stiffness of which can be varied by varying the force introduction in its spring damper unit. As can be seen, the spring damper unit of this arrangement 31 is formed by two polymer spring elements 18 which are attached to a first connection plate 27 in such a way that they can be inclined at one end with respect to the intended load direction. At its other end the polymer spring elements 18 can be attached in an inclined way at spindle nuts 28 which can be moved in a direction perpendicular to the load direction B towards one another or away from one another by means of a setting spindle 29, such that the polymer spring elements 18 can be inclined by a desired angle α with respect to the load direction B. The spindle nuts 28 are arranged in a guide 32 in a second connecting plate 30 in such a way that, in case of loading the second connecting plate 30 with a force acting in the intended load direction B, this force is introduced into the polymer spring elements 18 and is transmitted to the first connecting plate 27. The larger the set inclination angle α of the polymer spring 18 is with respect to the intended load direction B, the smaller is the spring stiffness of this spring damper arrangement 31.

Figure 11:
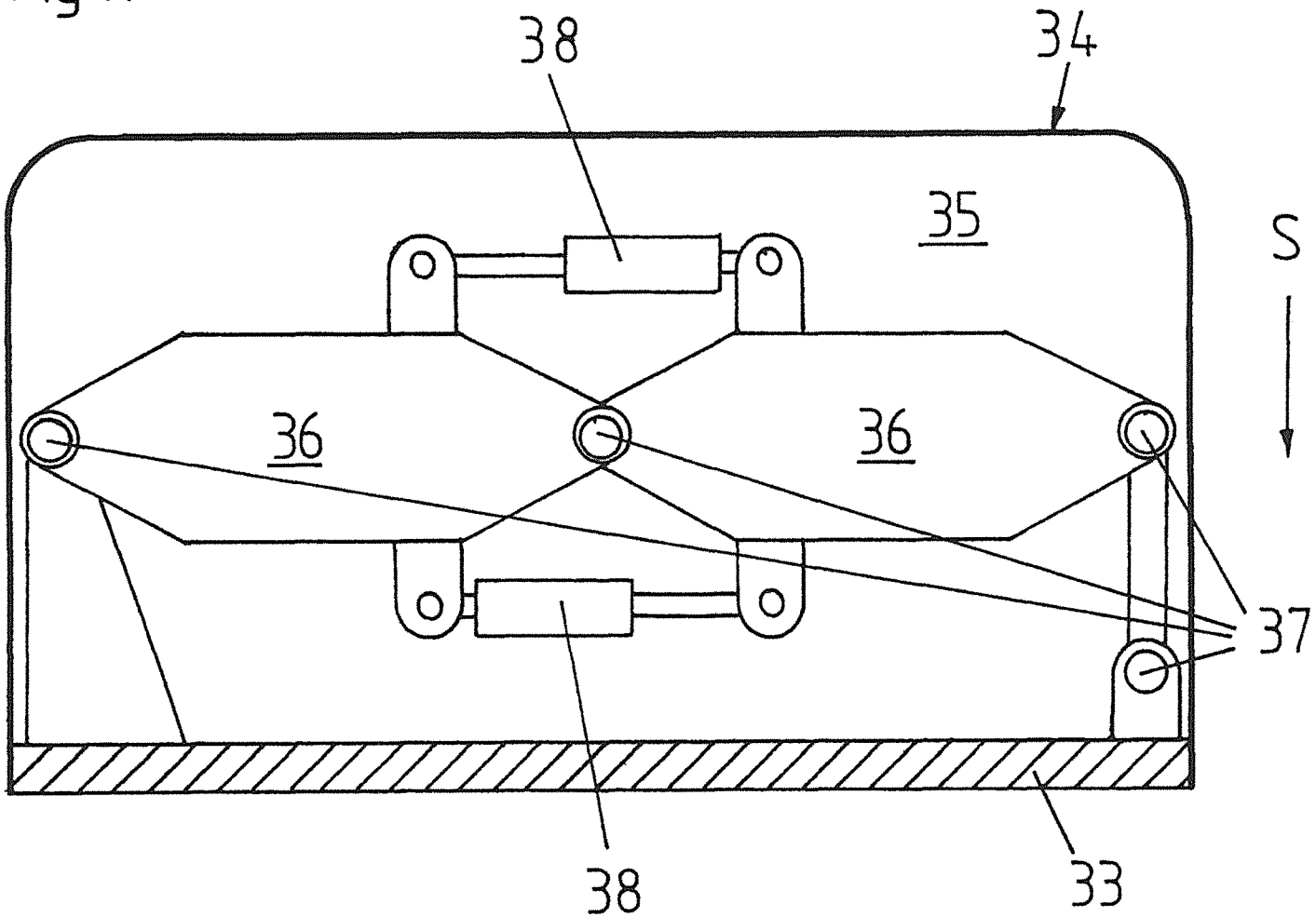
FIG. 11 a section through a vibration damper part with adjustable mass moment of inertia.

FIG. 11 shows a section through a vibration damper part with variable mass moment of inertia. The vibration damper part comprises a base plate 33 and a top cover 34, which form together a closed space 35. Two damper weights 36, each with a constant mass, are arranged in this space 35 and connected to one another and to the base plate 33 via joint arrangements 37 and pneumatic spring elements 38 in such a way that they can be moved towards each other when the vibration damper part is accelerated in and against the direction of gravity S against the spring force of the spring elements 38. The spring force of the spring elements 38 can be varied in operation by changing the pressure in its cylinder chambers via conduits with pressurized air (not shown). By this, the mass moment of inertia of this vibration damper part can be varied in and against the direction of gravity.

While preferred embodiments of the invention have been described in the present application, it is clearly stated that the invention is not limited thereto and may be executed in another way within the scope of the now following claims.

The invention claimed is:

1. Arrangement for providing a pulsing compressive force, comprising a) an exciter part with an unbalance exciter for producing an intermittent exciter force and with a contact surface for transmitting a force component of the exciter force, directed perpendicularly to the contact surface, as a pulsing compressive force, to a tool or a work surface to be impinged with the compressive force, and b) a vibration damper part which is connected to the exciter part by means of a spring damper unit, for forming a system capable of being excited to resonant oscillations by the unbalance exciter, characterized in that the arrangement has an idle part which is connected to the exciter part or to the vibration damper part in such a way that it forms a contiguous unit with the exciter part or the vibration damper part, but is however substantially decoupled from them in terms of oscillations, the arrangement is further adapted to vary during operation the spring stiffness (k2) of the spring damper unit, the damping (d2) of the spring damper unit, the spring pre-load of the spring damper unit, and the arrangement is formed in such a way that a variation of the mass (m2) of the vibration damper part, the mass moment of inertia of the vibration damper part, the mass (m1) of the exciter part, and/or the mass moment of inertia of the exciter part is possible by exchanging one or more liquid volumes between the idle part and the exciter part and/or the vibration damper part.

2. Arrangement according to claim 1, characterized in that the unbalance exciter (2) is formed as directed vibrator or as circular vibrator, in order to generate an intermittent exciter force.

3. Arrangement according to claim 1, characterized in that the arrangement is formed in such a way that the vibration damper part is exclusively supported on the exciter part in the direction of gravity via the spring damper unit when operated as intended.

4. Arrangement according to claim 1, characterized in that the arrangement is formed in such a way that the vibration damper part is partially supported on the exciter part via the spring damper unit and on supporting means which are formed separately from the exciter part when operated as intended.

5. Arrangement according to claim 1, characterized in that the idle part is supported entirely by the exciter part, or by the vibration damper part when operated, as intended.

6. Arrangement according to claim 1, characterized in that the idle part is supported entirely by supporting means which are substantially decoupled from the exciter part and the vibration damper part in terms of oscillations, when operated as intended.

7. Arrangement according to claim 1, characterized in that the idle part is supported partially by the exciter part or by the vibration damper part, and partially by supporting means which are substantially decoupled from the exciter part and the vibration damper part in terms of oscillations, when operated as intended.

8. Arrangement according to claim 7, characterized in that the arrangement is formed in such a way that in operation a variation of the weight distribution between the weight portion of the idle part which has to be supported by the exciter part or the vibration damper part, and the weight portion of the idle part which has to be supported by the supporting means is possible, particularly by shifting a weight on the idle part.

9. Arrangement according to claim 1, characterized in that the vibration damper part and/or the exciter part has at least two masses which are movable towards one another when accelerating the vibration damper part or the exciter part respectively, in a direction perpendicular to the contact surface against a spring force, wherein the spring force is variable in operation, for changing the mass moment of inertia of the vibration damper part or of the exciter part respectively.

10. Arrangement according to claim 1, characterized in that the arrangement is formed in such a way that a variation of the spring stiffness (k2) of the spring damper unit is possible by stiffening spring elements of the spring damper unit and/or by varying the force introduction in spring elements of the spring damper unit, particularly by varying a transmission of the introduced forces.

11. Arrangement according to claim 1, characterized in that the arrangement is formed in such a way that the frequency (Q1) of the exciter force (F1), the quantity of the exciter force (F1) and/or the direction of action of the exciter force (F1) of the unbalance exciter are variable during operation.

12. Arrangement for providing a pulsing compressive force, comprising a) an exciter part with an unbalance exciter for producing an intermittent exciter force and with a contact surface for transmitting a force component of the exciter force, directed perpendicularly to the contact surface, as a pulsing compressive force, to a tool or a work surface to be impinged with the compressive force, and b) a vibration damper part which is connected to the exciter part by means of a spring damper unit, for forming a system capable of being excited to resonant oscillations by the unbalance exciter, characterized in that the arrangement is adapted to vary during operation the spring stiffness (k2) of the spring damper unit, the damping (d2) of the spring damper unit, the spring pre-load of the spring damper unit and the mass (m2) of the vibration damper part, the mass moment of inertia of the vibration damper part, the mass (m1) of the exciter part, and/or the mass moment of inertia of the exciter part, and the arrangement is formed in such a way that a variation of the mass (m2) of the vibration damper part, the mass moment of inertia of the vibration damper part, the mass (m1) of the exciter part, and/or the mass moment of inertia of the exciter part is possible by exchanging one or more liquid volumes between the idle part and the exciter part and/or the vibration damper part.

13. Arrangement for providing a pulsing compressive force, comprising a) an exciter part (1, 23) with an unbalance exciter (2) for producing an intermittent exciter force and with a contact surface (3) for transmitting a force component of the exciter force, directed perpendicularly to the contact surface, as a pulsing compressive force, to a tool or a work surface (4) to be impinged with the compressive force, and b) a vibration damper part (5, 25) which is connected to the exciter part (1, 23) by means of a spring damper unit (15, 15*a*, 15*b*, 18, 18*a*, 18*b*, 22, 22*a*, 22*b*), for forming a system capable of being excited to resonant oscillations by the unbalance exciter (2), characterized in that the arrangement comprises a controlling unit or regulating unit by means of which the spring stiffness (k2) of the spring damper unit, the damping (d2) of the spring damper unit, the spring pre-load of the spring damper unit, the mass (m2) of the vibration damper part, the mass moment of inertia of the vibration damper part, the mass (m1) of the exciter part, and/or the mass moment of inertia of the exciter part is or are automatically adjustable in operation depending on measured system variables in such a way that the vibration damper part oscillates in resonance with the exciter part with the same frequency or half of the frequency of the exciter part.

14. Arrangement according to claim 13, characterized in that additionally the frequency (Q1) of the exciter force (F1), the quantity of the exciter force (F1) and/or the direction of action of the exciter force (F1) of the unbalance exciter is or are variable during operation, and are automatically adjustable in operation depending on measured system variables, particularly in such a way that the vibration damper part oscillates in resonance with the exciter part particularly with the same frequency or with half of the frequency of the exciter part by means of the controlling unit or regulating unit respectively.

* * * * *